US010595630B2

(12) United States Patent
Lam et al.

(10) Patent No.: US 10,595,630 B2
(45) Date of Patent: Mar. 24, 2020

(54) ADJUSTABLE TABLE ASSEMBLY

(71) Applicant: Virco Mfg. Corporation, Torrance, CA (US)

(72) Inventors: Keen Lam, Roland Heights, CA (US); Scott Lloyd Fletcher, Redondo Beach, CA (US); Jonathan Kyle Yau, Torrance, CA (US)

(73) Assignee: Virco Mfg. Corporation, Torrance, CA (US)

( * ) Notice: Subject to any disclaimer, the term of this patent is extended or adjusted under 35 U.S.C. 154(b) by 0 days.

(21) Appl. No.: 16/164,450

(22) Filed: Oct. 18, 2018

(65) Prior Publication Data

US 2019/0116970 A1 Apr. 25, 2019

Related U.S. Application Data

(60) Provisional application No. 62/575,293, filed on Oct. 20, 2017.

(51) Int. Cl.

| | |
|---|---|
| ***A47B 13/08*** | (2006.01) |
| ***A47B 3/08*** | (2006.01) |
| ***A47B 3/00*** | (2006.01) |

(52) U.S. Cl.

CPC ..... *A47B 13/081* (2013.01); *A47B 3/00* (2013.01); *A47B 3/0818* (2013.01); *A47B 2200/0036* (2013.01); *A47B 2200/0043* (2013.01)

(58) Field of Classification Search

CPC . A47B 3/00; A47B 3/0818; A47B 2200/0036; A47B 2200/0043

(Continued)

(56) References Cited

U.S. PATENT DOCUMENTS 1,709,927 A * 4/1929 Whitney ..... A47B 3/0815 108/18
3,183,860 A * 5/1965 Kritske ..... A47B 27/02 108/2

(Continued)

OTHER PUBLICATIONS

Office Action issued in Canadian application No. 3,021,402 dated Sep. 18, 2019.

*Primary Examiner* — Jose V Chen
(74) *Attorney, Agent, or Firm* — Knobbe, Martens, Olson & Bear, LLP

(57) ABSTRACT

The present disclosure provides a system for an adjustable table assembly that can be positioned in as storage and a usage position. The table assembly can include one or more legs supporting a table. The table assembly uses one or more movement control brackets and one or more locking members to secure the table in the usage position and the storage position. The bracket has a defined path that is followed by the locking member as the table is moved between the usage position and the storage position. When the table is in the usage position or the storage position, the locking member moves into a locking position within a corresponding locking portion of the bracket. When the locking member is in the locking position, movement of the table is substantially prevented. Specifically, angular movement of the tabletop is prevented. A user can move the locking member out of the locking portion and into a movement portion of the movement control bracket. When the locking member is positioned within the movement portion, the tabletop can move from the usage position to the storage position, and visa-versa.

13 Claims, 12 Drawing Sheets

(58) Field of Classification Search
USPC ..... 108/115, 8
See application file for complete search history.

(56) References Cited

U.S. PATENT DOCUMENTS

| | | | | | |
|---|---|---|---|---|---|
| 3,988,021 | A * | 10/1976 | Grover | A47B 3/00 | 473/15 |
| 5,927,214 | A * | 7/1999 | Schwartz | A47B 3/0815 | 108/115 |
| 6,192,808 | B1 * | 2/2001 | Bue | A47B 3/0911 | 108/1 |
| 6,257,153 | B1 * | 7/2001 | Portugal | A47B 1/04 | 108/115 |
| 7,066,098 | B2 * | 6/2006 | Blasen | A47B 3/08 | 108/115 |
| 7,614,351 | B2 * | 11/2009 | Piretti | A47B 3/0815 | 108/1 |
| 7,631,604 | B2 * | 12/2009 | Huang | A47B 3/08 | 108/115 |
| 7,703,400 | B2 * | 4/2010 | Mockel | A47B 3/0803 | 108/115 |
| 7,878,128 | B2 * | 2/2011 | Watson | A47B 3/0803 | 108/115 |
| 8,091,488 | B2 * | 1/2012 | Chirea | A47B 7/02 | 108/115 |
| 8,181,583 | B2 * | 5/2012 | Rivera, Jr. | A47B 3/14 | 108/168 |
| 8,359,983 | B2 * | 1/2013 | Williamson | A47B 3/00 | 108/115 |
| 9,642,451 | B2 * | 5/2017 | Okuda | A47B 3/08 | |
| 2007/0261611 | A1 * | 11/2007 | Kumazawa | A47B 3/0815 | 108/115 |
| 2008/0295742 | A1 * | 12/2008 | Henriott | A47B 21/00 | 108/6 |
| 2009/0283020 | A1 * | 11/2009 | Hsu | A47B 3/0815 | 108/115 |
| 2010/0071600 | A1 * | 3/2010 | Lin | A47B 3/08 | 108/115 |
| 2011/0139042 | A1 * | 6/2011 | Korb | A47B 3/00 | 108/115 |
| 2011/0290159 | A1 * | 12/2011 | Saito | A47B 3/08 | 108/115 |
| 2015/0033990 | A1 * | 2/2015 | Yeager | A47B 85/06 | 108/15 |
| 2015/0118010 | A1 * | 4/2015 | Krusin | A47B 7/02 | 414/801 |

* cited by examiner

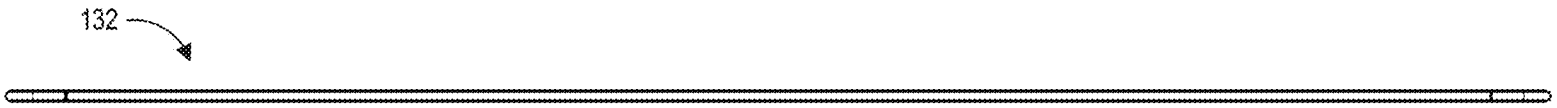
FIG. 23
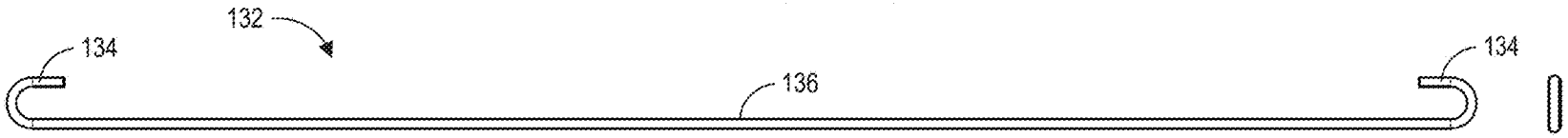
FIG. 24
FIG. 25
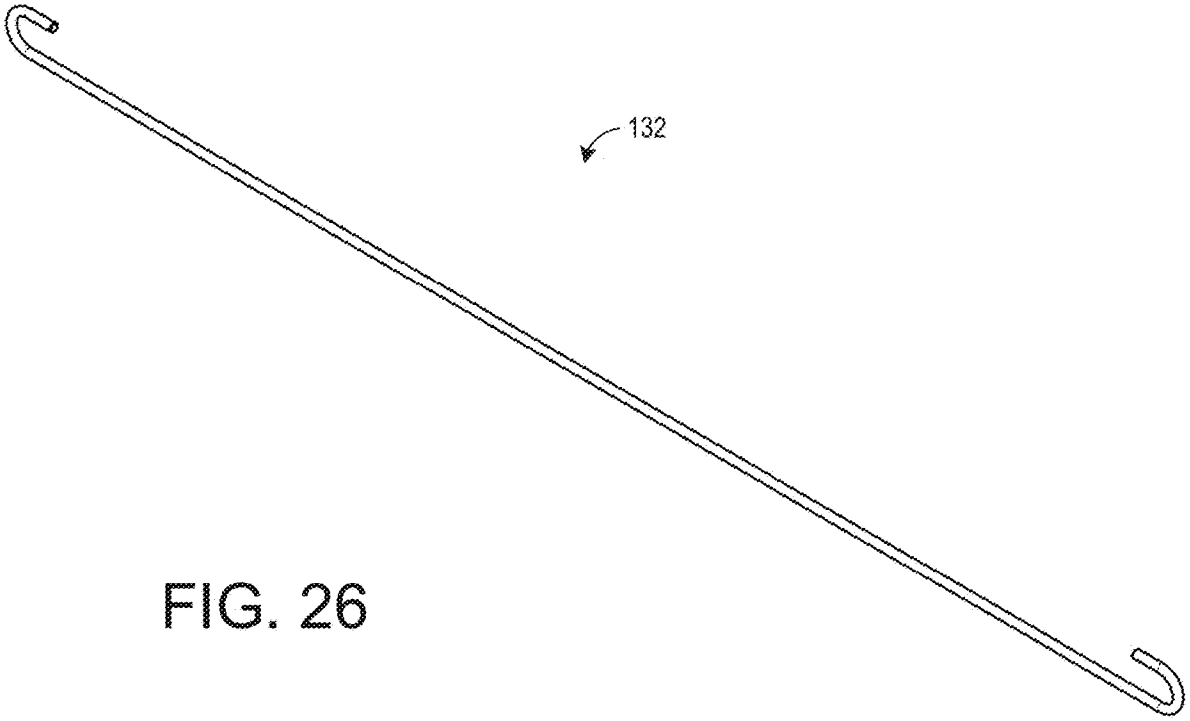
FIG. 26

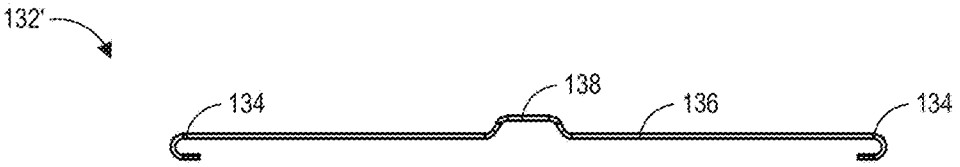
FIG. 27
FIG. 28
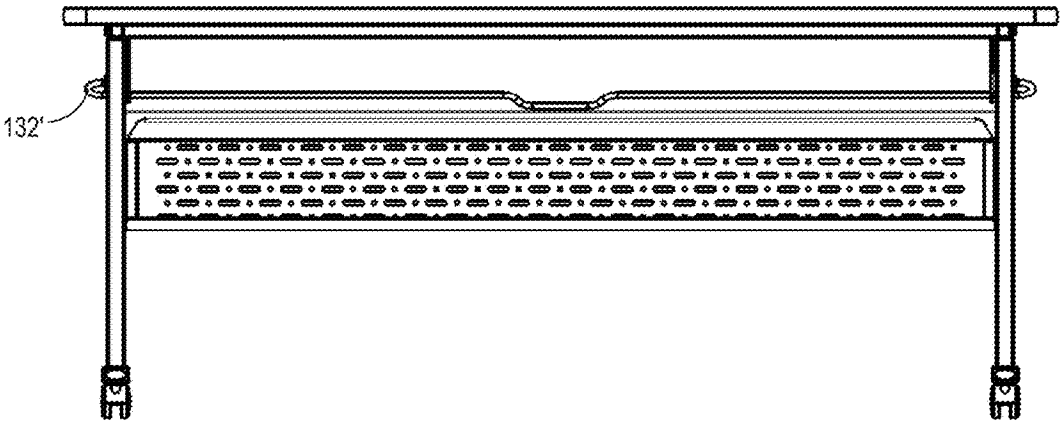
FIG. 29

ADJUSTABLE TABLE ASSEMBLY

BACKGROUND OF THE INVENTION

Field of the Invention

The present invention generally relates to an adjustable table assembly.

Description of the Related Art

Setting up tables for meetings can be a time consuming and difficult task. Depending on the number of people and the size of each table, the task can be very labor intensive. Tables can be heavy and may require multiple people to effectively move the tables into position. Attempting to lift and setup heavy tables can result in injuries to the workers. Generally, the tables cannot remain set up because they take up too much space and therefore must be continually set up and taken down each time there is a meeting.

SUMMARY OF SOME EMBODIMENTS

In accordance with certain features, aspects and advantages of at least one of the embodiments disclosed herein, a table comprises: a top member configured to move between a first position and a second position; a first leg and a second leg opposing each other; at least one hinge component coupled to the top member and at least one of the first leg or the second leg; at least one movement guide bracket coupled to the table top, the movement guide bracket comprising a guide path, the guide path having at least a first locking portion and a movement portion; a locking member coupled to at least one of the first leg or the second leg, at least a portion of the locking member positioned within the guide path of the movement guide bracket; wherein when the locking member is positioned within the first locking portion of the guide path, the top member is locked in the first position, wherein when the locking member is positioned within the movement portion of the guide path, the top member is movable between the first position and the second position.

In some embodiments, the first position, the top member is positioned substantially horizontal. In some embodiments, in the second position, the top member is positioned substantially vertical. In some embodiments, the table further comprises a plurality of casters coupled to the first leg and the second leg.

In some embodiments, the at least one movement guide bracket includes a first movement guide bracket associated with the first leg and a second movement guide bracket associated with the second leg.

In some embodiments, the locking member comprises an elongate body that extends from the from at least the first movement guide bracket to the second movement guide bracket.

In some embodiments, the locking member is configured to automatically move into the first locking portion after the top member moves from the second position to the first position. In some embodiments, the locking member automatically drops into the first locking portion after the table member moves into the first position. In some embodiments, the locking member substantially prevents angular movement of the top member when the locking member is positioned in the first locking portion of the guide path.

In some embodiments, the guide path further includes a second locking portion. In some embodiments, the locking member is configured to automatically move into the second locking portion after the top member moves from the first position to the second position. In some embodiments, the guide path further includes one or more intermediate locking portions. In some embodiments, the locking member is configured to lock the position of the top member in an intermediate position between the first position and the second position when the locking member is positioned in one of the one or more intermediate locking positions. In some embodiments, the guide path is an arcuate path.

Features from one or more embodiments or configurations may be combined with features of one or more other embodiments or configurations.

The term 'comprising' as used in this specification means 'consisting at least in part of'. When interpreting each statement in this specification that includes the term 'comprising', features other than that or those prefaced by the term may also be present. Related terms such as 'comprise' and 'comprises' are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

It should be understood that alternative embodiments or configurations may comprise any or all combinations of two or more of the parts, elements or features illustrated, described or referred to in this specification.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

FIG. 23 is a top view of an embodiment of a locking member.

FIG. 24 is a front view of the locking member of FIG. 23.

FIG. 25 is a side view of the locking member of FIG. 23.

FIG. 26 is a perspective view of the locking member of FIG. 23.

FIG. 27 is a front view of another embodiment of a locking member.

FIG. 28 is a top view of the locking member of FIG. 27.

FIG. 29 is a front view of a table with the locking member of FIG. 27.

DETAILED DESCRIPTION OF THE SOME EMBODIMENTS

Figure 1:
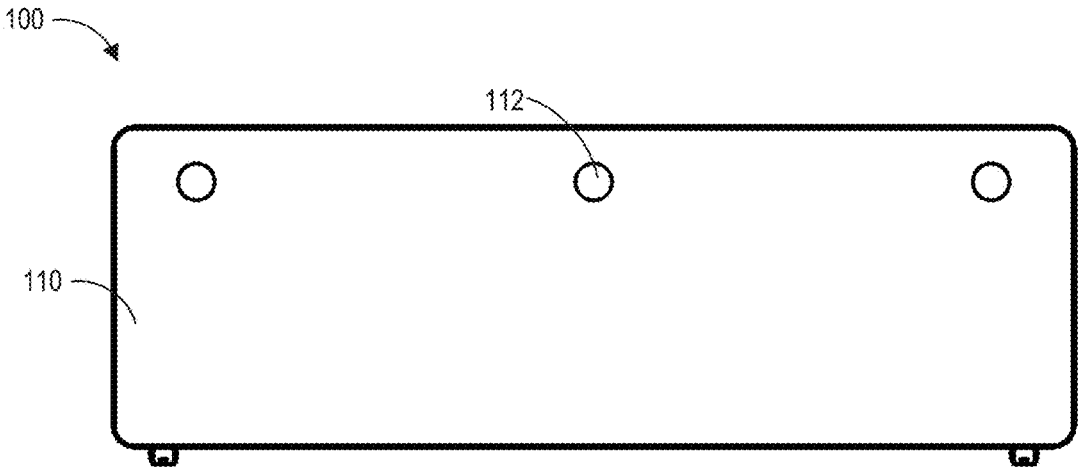
FIG. 1 is a top view of an embodiment of a table in a usage position.
Figure 2:
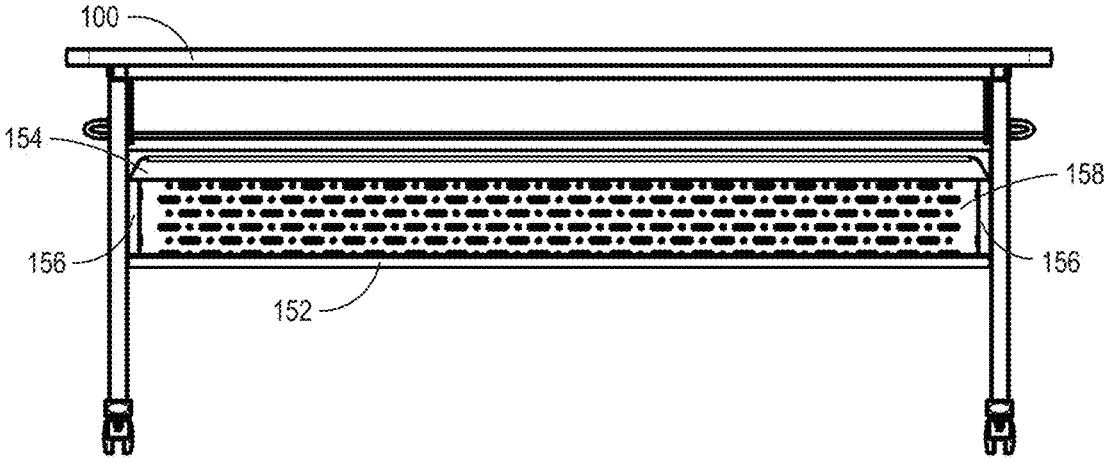
FIG. 2 is a front view of the table of FIG. 1.
Figure 3:
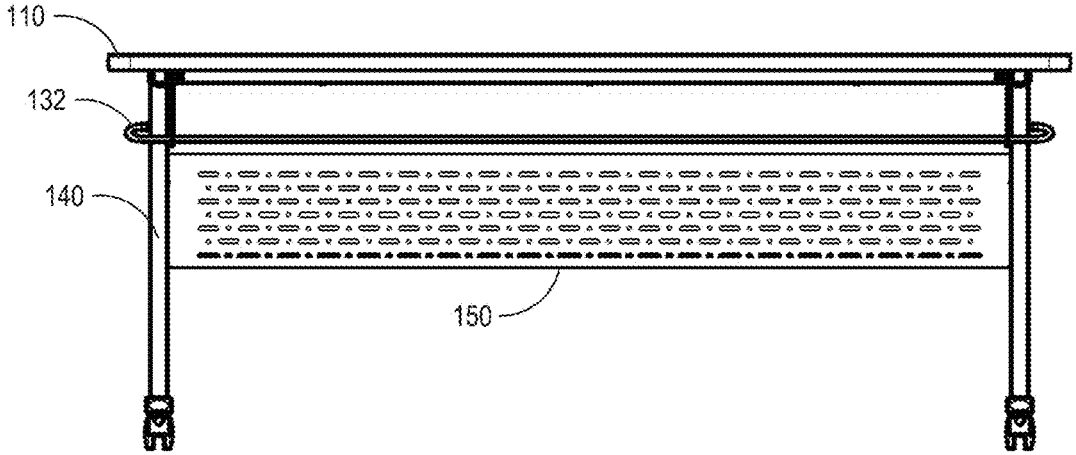
FIG. 3 is a back view of the table of FIG. 1.
Figure 4:
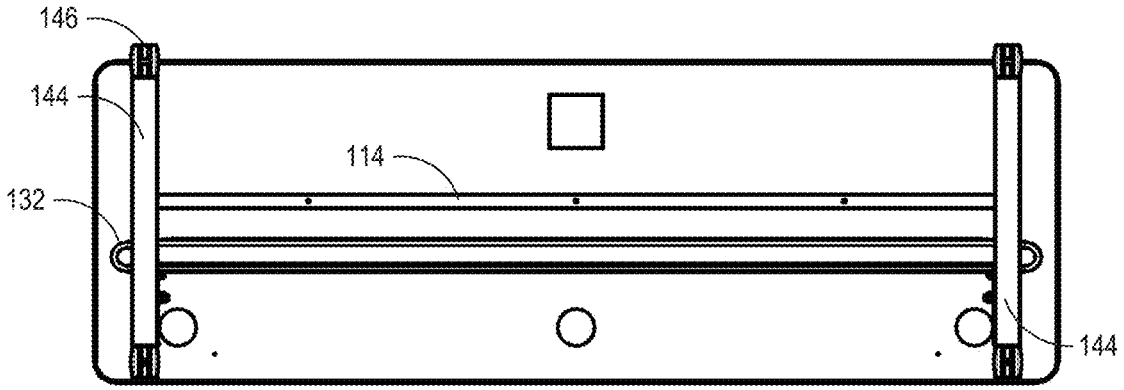
FIG. 4 is a bottom view of the table of FIG. 1.
Figure 5:
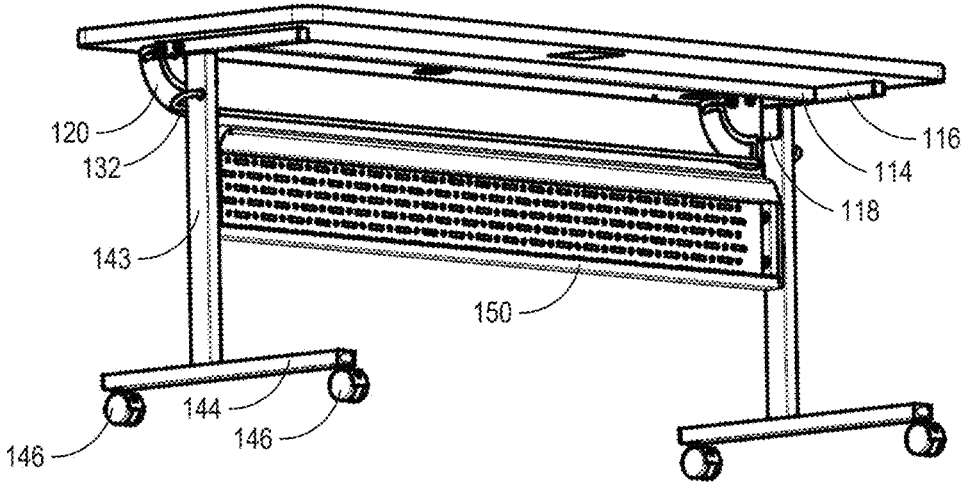
FIG. 5 is a perspective view of the table of FIG. 1.
Figure 6:
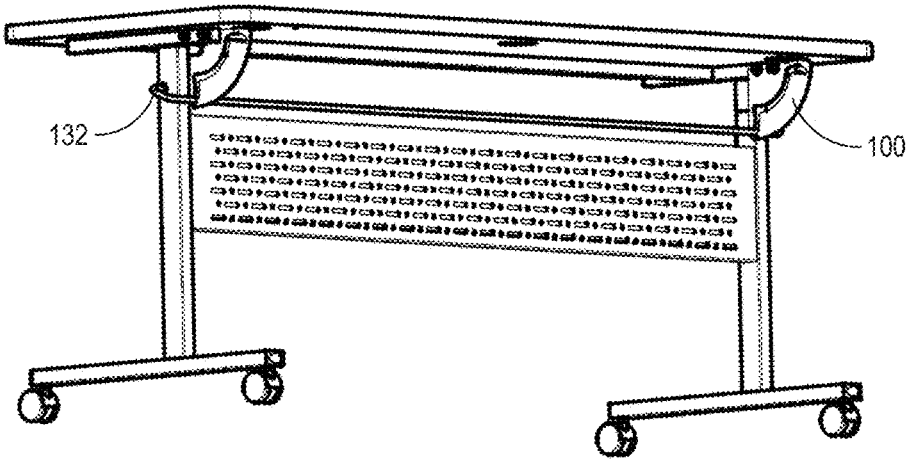
FIG. 6 is another perspective view of the table of FIG. 1.
Figure 7:
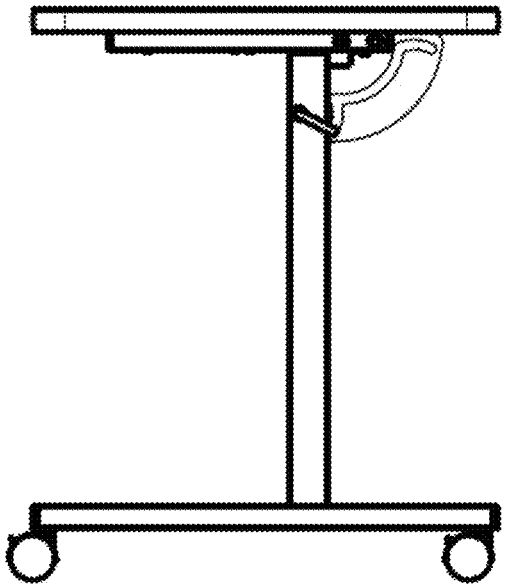
FIG. 7 right view of the table of FIG. 1.
Figure 8:
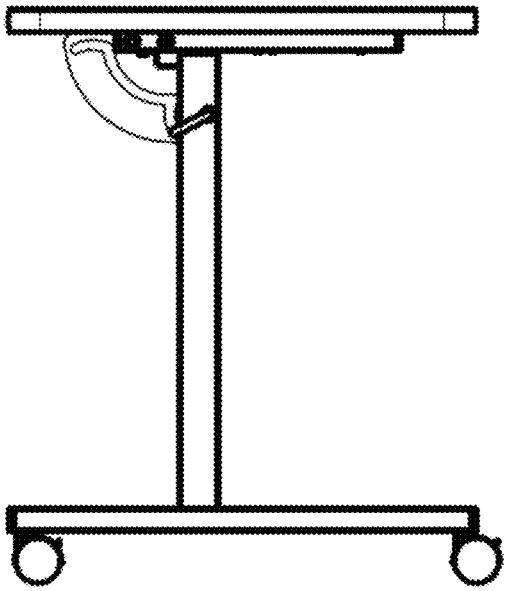
FIG. 8 left view of the table of FIG. 1.
Figure 9:
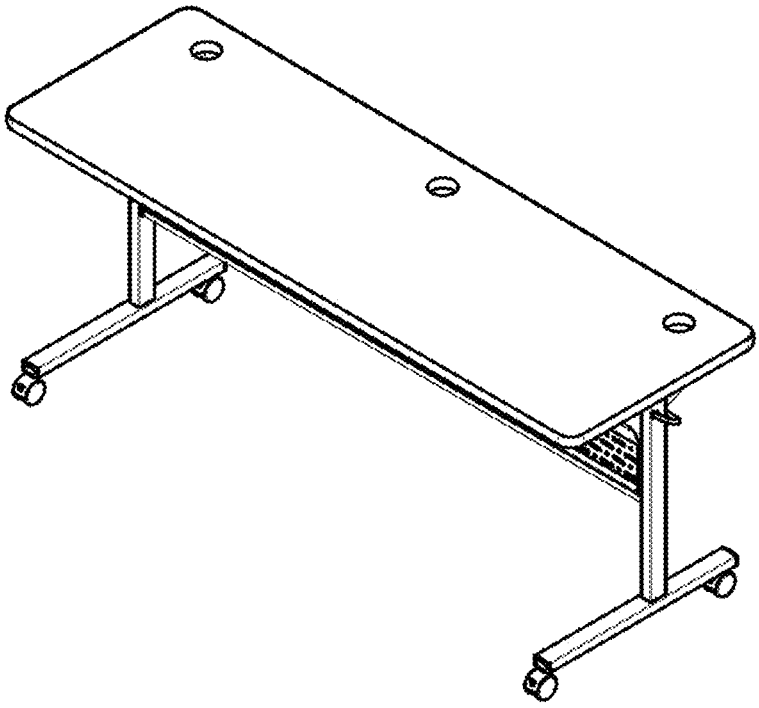
FIG. 9 is another perspective view of the table of FIG. 1.
Figure 10:
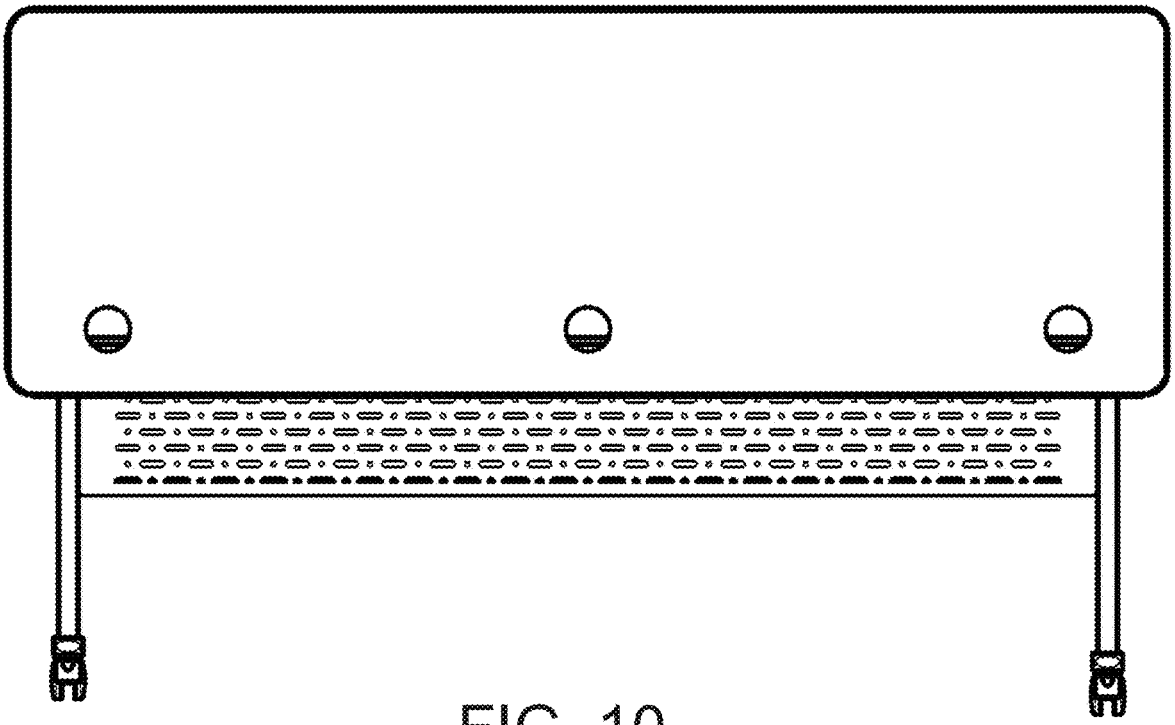
FIG. 10 is a back view of the table in a storage position.
Figure 11:
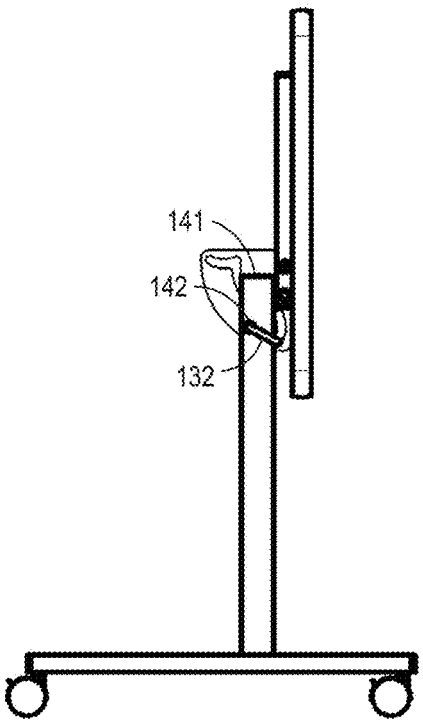
FIG. 11 is a right side view of the table of FIG. 10.
Figure 12:
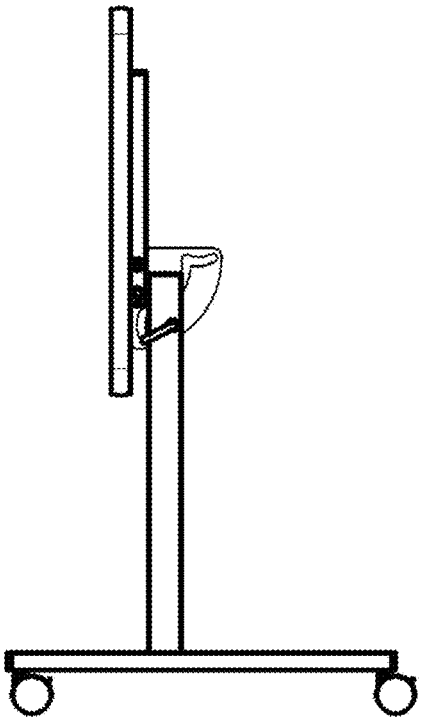
FIG. 12 is a left side view of the table of FIG. 10.
Figure 13:
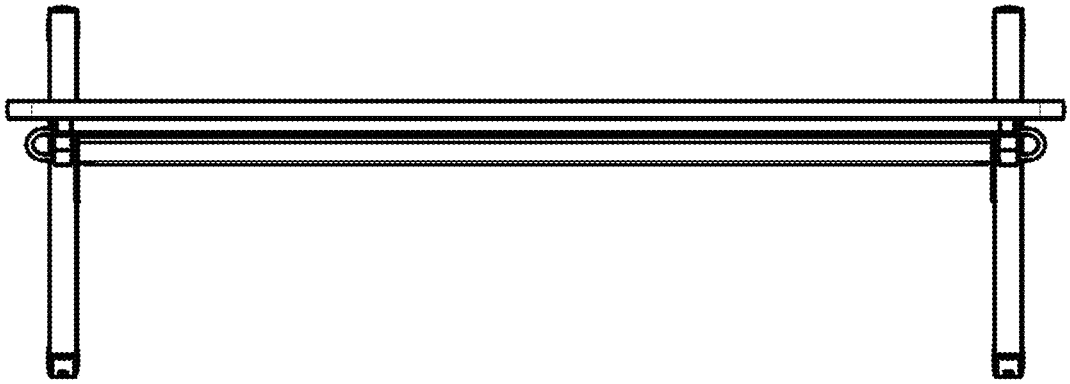
FIG. 13 is a top view of the table of FIG. 10.
Figure 14:
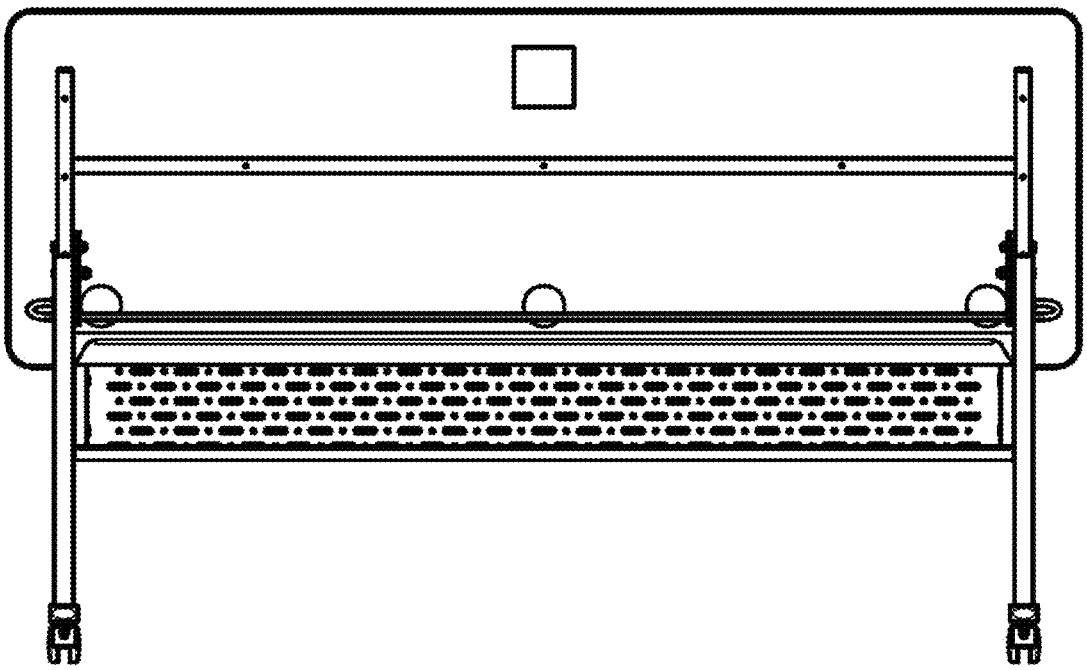
FIG. 14 is a front view of the table of FIG. 10.
Figure 15:
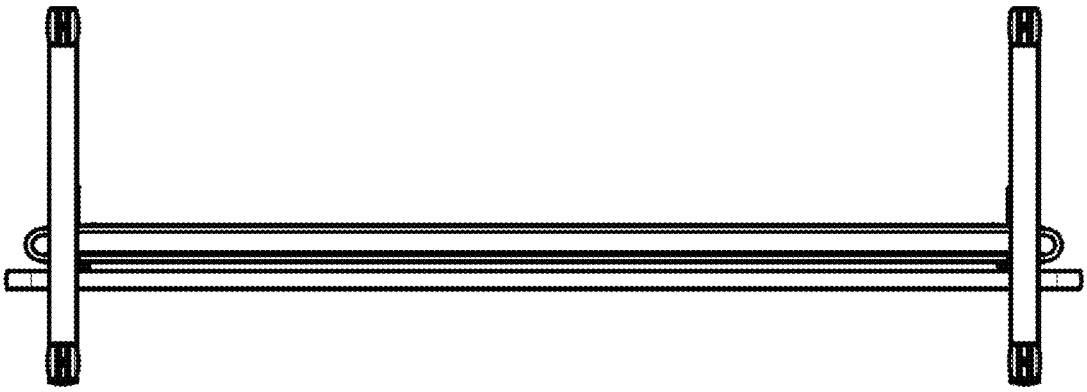
FIG. 15 is a bottom view of the table of FIG. 10.
Figure 16:
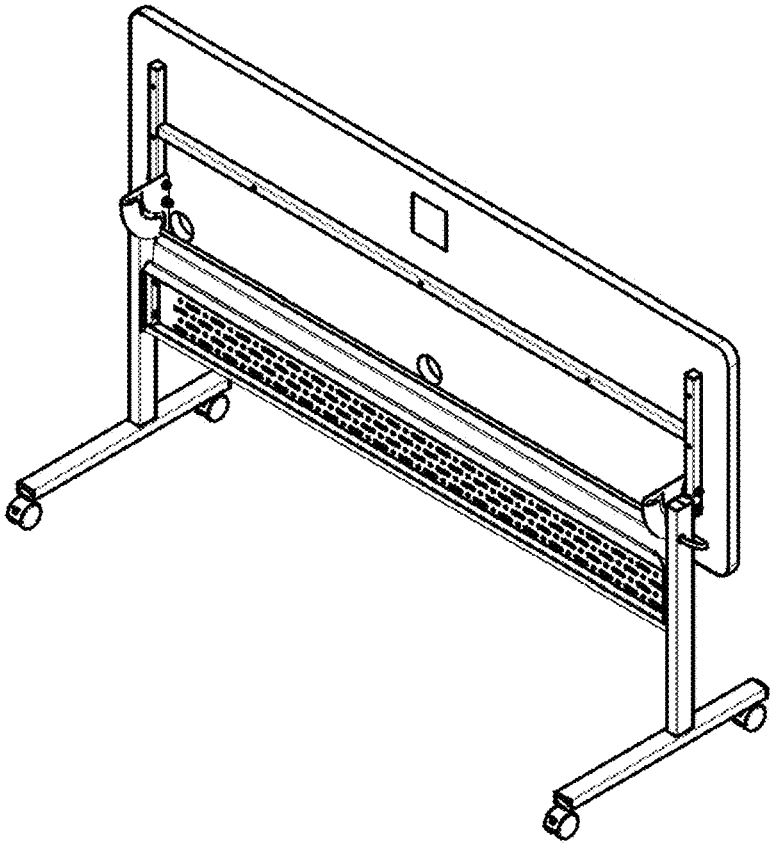
FIG. 16 is a front perspective view of the table of FIG. 10.
Figure 17:
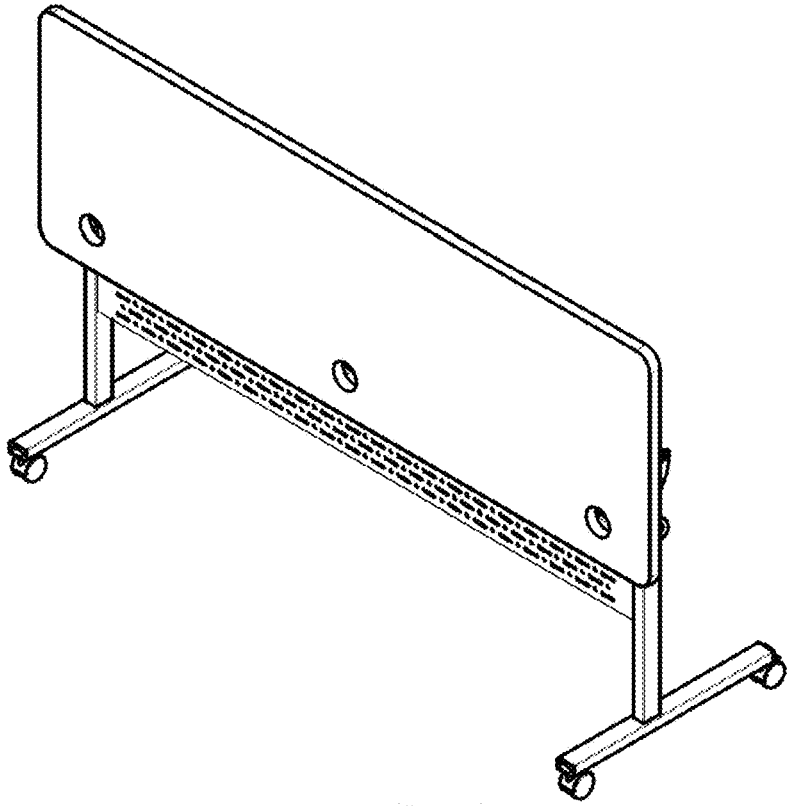
FIG. 17 is a back perspective view of the table of FIG. 10.
Figure 20:
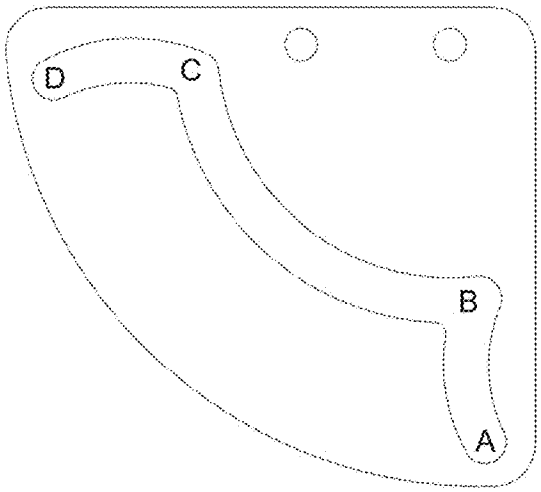
FIG. 20 is a back view of the bracket of FIG. 18.
Figure 19:
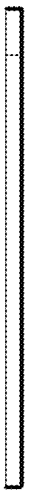
FIG. 19 is a side view of the bracket of FIG. 18.
Figure 22:
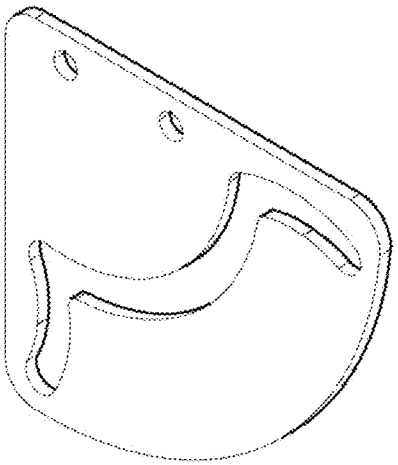
FIG. 22 is a perspective view of the bracket of FIG. 18.
Figure 18:
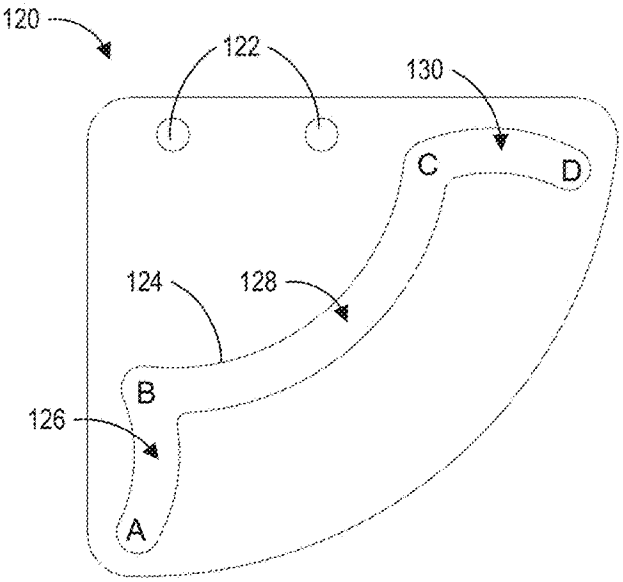
FIG. 18 is a front view of an embodiment of a movement control bracket.
Figure 21:
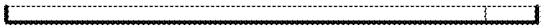
FIG. 21 is a bottom view of the bracket of FIG. 18.

There exists a need for tables that can be mobile and usable without taking up too much space. The present disclosure provides a mobile table that can be positioned in a storage that is positioned substantially upright within a storage position. The table can transition between a usage position and the storage position without adjusting the legs of the table. The table may include wheels, which can help to move the table around in the usage position or the storage position. This can allow the table to be quickly set up and moved, which can significantly reduce the effort and labor required to set up the tables. Additionally, the tables can have a small footprint in the storage position and multiple tables can be stored in a smaller location.

Additionally it is desirable for the table to have a mechanism that is easy to use and not prone to failure. The mechanism should also not reduce the usability of the table or make the table unstable during use. For example in the usage position the table needs to provide a firm level surface that does not move when people apply pressure to the top of the table.

The present disclosure provides a system for an adjustable table assembly that can be positioned in as storage and a usage position. The table assembly can include one or more legs supporting a table. The table assembly uses one or more movement control brackets and one or more locking members to secure the table in the usage position and the storage position. The bracket has a defined path that is followed by the locking member as the table is moved between the usage position and the storage position. When the table is in the usage position or the storage position, the locking member moves into a locking position within a corresponding locking portion of the bracket. When the locking member is in the locking position, movement of the table is substantially prevented. Specifically, angular movement of the tabletop is prevented. A user can move the locking member out of the locking portion and into a movement portion of the movement control bracket. When the locking member is positioned within the movement portion, the tabletop can move from the usage position to the storage position, and visa-versa.

FIGS. 1-9 illustrate a table 100 in a usage position. The usage position may also be referred to as a first position, a horizontal position, or a substantially horizontal position. FIGS. 10-17 illustrate the table 100 in an upright position, also referred to as a storage position, a second position, a vertical position, or a substantially vertical position. The table has a pivotally adjustable top member 110, which is generally planar, and is supported by legs 140 that extend downward from the top member 110. In the illustrated configuration, while the top member 110 generally overlays the legs 140, the legs 140 and the top member 110 are not directly secured together. Rather, in the illustrated configuration, the legs 140 are connected to the top member 110 by one or more hinge structures 118 that are configured to allow the top member 110 to move between the upright and usage positions. When the top member 110 is in the usage position it can have a substantially horizontal orientation. In the storage position the top member 110 can have a substantially vertical orientation. Stated differently, the usage position can be substantially perpendicular relative to the storage position.

The top member 110 can have any suitable configuration. In the illustrated configuration, the top member 110 is generally rectangular with rounded corners. Any other combination of sides or shapes of the top member 110 can also be used. The top member 110 can include one or more openings or apertures 112 that extend through the top surface. The top member 110 can include any number of openings 112 or no openings at all, which can be any shape or configuration. In the illustrated embodiment, the top member 110 has three openings 112 that extend through the top member 110. In the illustrated configuration, the legs 140 are inset relative to the sides of the top member 110 and the legs 140 are disposed substantially within the footprint of the tabletop member 110 in the usage position. In some configurations, the width of the top member 110 can be between 12 inches and 48 inches, and the length of the top can be between 20 inches and 96 inches. In some configurations, the top member 110 can be formed of a metallic material, a laminate material, or other suitable material. The laminate material can be a plywood material.

On the underside, the top member 110 has a supporting member 114 and lateral support members 116. The support members 114 and 116 can be secured to the bottom of the tabletop member 110 using one or more mechanical fasteners, such as threaded fasteners. The support member 114 can abut a mid-section of each lateral support member 116. In some configurations, the lateral support members 116 and the support member 114 can be formed as a single structure. The lateral and support members may be welded together or secured together using another suitable method. In some configurations, the lateral support members 116 and the support member 114 may not be secured to each other. Any suitable configuration for the lateral support members 116 and the support member 114 can be used. A hinge structure 118 can be coupled to each of the lateral support members 114 and the legs 140. The hinge structure 118 provides for movement of the tabletop member 110 between the usage position and the storage position by a user. The hinge structures 118 are configured so that when the top member 110 is in the usage position, the top member 110 rests on top 141 of the legs 140, and when the top member is in the storage position, the tabletop member 110 rests against the side of the upper portion 143 of legs 140.

A movement control bracket 120 can be secured to the lateral support member 116. In the illustrated configuration, movement control brackets 120 are secured to each of the lateral support members 116. In some configurations, only one movement control bracket 120 is used. The movement control bracket 120 will be described later and is further illustrated in FIGS. 18-22. Additional embodiments of the bracket 120 are illustrated in FIGS. 30-36. A locking member 132 positioned within and interfaces with the bracket 120. The locking member 132 is secured to the leg 140. The locking member 132 is illustrated in further detail in FIGS. 23-29.

Two opposing legs 140 extend downwardly from the top member 110. The legs 140 have upper portions 143 and include lower portions 144. The top 141 of the legs 140 may have a plastic member or plug secured within the top of the leg. The upper portion 143 includes openings 142 for securing the locking member 132 to the legs 140. The openings 142 are configured so that the locking member 132 can rotate within the openings 142. The bottom portions 144 are configured to be of sufficient length to stabilize the top member 110 and to help prevent the table 100 from toppling in the upright or usage positions. In the illustrated configuration, the upper portion 143 is connected to the lower portion 144 at a position that is offset from the center of the lower portion 144 in order to counterbalance the weight of the top portion 110. The positioning of the upper portion 143 on the lower portion 144 can increase stability and decrease the chance that the table will topple over when a person is using or moving the table. The lower portion 144 can include casters 146 or other types of mobility members for moving the table in the usage or upright positions. The casters 146 can include a locking mechanism so that the casters 146 can be locked when the table is in use and unlocked when the table needs to move. The legs 140 can be formed of any suitable material. In some configurations, the legs can be formed from a metallic material or laminate material. The upper portions 143 and lower portions 144 can be formed from the same or different materials. The upper portions 143 and the lower portions 144 may be connected by mechanical fasteners, welded together, or secured together using another suitable method. In some configurations, the upper portions 143 and the lower portions 144 can be formed as a single structure. The legs 140 can include a substructure 150 positioned between the legs 140. The shape and structure of the legs can be any suitable configuration.

In the illustrated configuration, the legs 140 are connected to the substructure 150. The legs 140 can be connected to the substructure 150 in any suitable manner. In some configurations, mechanical fasteners are used to connect the legs 140 to the substructure 150. In some such configurations, the mechanical fasteners can be threaded fasteners. Any other suitable configuration can be used. The substructure 150 can have any suitable configuration. In the illustrated configuration, the substructure 150 has a box-like structure. The substructure 150 can be formed of any suitable material. In the illustrated configuration, the substructure 150 can be formed of a metallic material. In some configurations, the metallic material can be steel or aluminum. In some such configurations, the substructure 150 can be laser cut or stamped from the material and then formed in any suitable manner. By forming the substructure of a metallic material, the substructure 150 can be painted to a color that is designed to complement the top member 110 and/or legs 140. The metallic material can help increase the load bearing capability of the table 100.

The substructure 150 comprises a lower wall 152, an upper wall 154, sidewalls 156, and back wall 158. The substructure 150 also includes one or more flange. Together, the walls and flanges can provide strength to the substructure and the table 100. In the illustrated configuration, threaded fasteners can extend through holes in the sidewalls 156 and into the legs 140. Other configurations also are possible. In the illustrated configuration, the back wall 158 includes a plurality of openings or perforations in a defined pattern. In other configurations, the back wall 158 may be solid or have a different number, shape, design, and or pattern of openings.

The substructure 150 can have any suitable configuration. In some configuration, the lower wall 152 forms a writing instrument retention channel. In some configurations, a door (not shown), a drawer (not shown), a keyboard tray (not shown), a storage box (not shown), or the like also can be used in conjunction with the substructure 150. While the substructure 150 can be used to interconnect the legs, in some configurations, further reinforcement may be desired.

With reference to FIGS. 18-22, the movement control bracket 120 is illustrated. The bracket 120 includes one or more openings 122 for securing the bracket to the lateral support member 116. In some configurations the bracket 120 may include additional or fewer openings 122. The openings 122 may have any suitable spacing, shapes, sizes, and configuration. The openings can be sized to receive a mechanical fastener in order to secure the bracket to the lateral support member 116. In some configurations, the bracket may not include any openings 122 and the bracket 120 may be secured to the lateral support member using another suitable method, such as welding.

The bracket 120 includes a guide path 124 for the locking member 132. In the illustrated configuration, the guide path 124 is divided into at least three sections, a first locking portion 126 (also referred to as a usage locking portion), a movement portion 128, and a second locking portion 130 (also referred to as a storage locking portion). The usage locking portion 126 extends from approximately position A to position B. The movement portion 128 extends from approximately position B to position C. The storage locking portion 130 extends from approximately position C to position D. As the table moves between usage position and the storage position, and visa-versa, the locking member moves along the guide path 124. When the locking member is a locking portion (either the first or second locking portion), the tabletop member 110 is in a locked position and cannot be moved between positions. When the locking member is in the movement portion, the tabletop member 110 is in an unlocked position and can be moved, which causes the locking member to move along path BC. As the tabletop member 110 moves into position B, which corresponds to the usage position, the locking member can automatically move along path AB until it rests in position A. As the tabletop member 110 moves into position C, which corresponds to the storage position, the locking member 132 automatically moves along path CD until it rests in position D. The bracket 120 is configured and oriented so that gravity automatically moves locking member 132 into the usage locking portion 126 or the storage position locking portion 130 based on the final position of the top member 110. The locking member 132 falls into its final resting place at position A or position D. The width and length of path AB and path CD are configured so that the locking member can easily move into the final position. Additionally, the locking portions are configured so that once the tabletop member 110 is moved into the storage position or usage position, the locking member automatically locks the top member 110 into place. The guide paths 124 can have varying widths, shapes, and lengths at different portions of the path. In some configurations, the locking portions may have tapering portions so that the locking member is more securely situated within path when in the final position and can more freely move while moving between the usage and storage positions.

As used herein, the term "unlocked position" refers to when the locking member 132 is positioned within the movement portion 128 of the guide path 124 that allows free movement of the top portion 110 between the storage position and the usage position. The movement path of the top member 110 along the movement portion of the guide path 124 is substantially defined by the configuration of the tabletop member 110, legs 140, and hinge structure(s) 118.

As used herein, the term "locked position" refers to when the locking member 132 is positioned in a locking portion of the guide path 124 and substantially prevents movement of the top portion 110 along the movement path defined by the hinge structures 118. Depending on the configuration, the locking member 132 in combination with the bracket 120 can prevent angular, lateral, or translation movement by the top member. For example when in the usage position. The tabletop remains in a substantially flat position and applying weight or attempting to move the top 110 relative to the legs 140 is substantially prevented. For example, the table can move less than 5 degrees, less than 4 degrees, less than 3 degrees, less than 2 degrees, or preferably less than 1 degree. Additionally, the table will remain substantially flat when a force is applied to either side of the tabletop. A locked position can refer to the final position of the locking member (e.g., position A or position D) or at any position within the locking portion prior to reaching the unlocked position (e.g., path AB or path CD)

In order to move the tabletop out of a locked position, the user must move the locking member 132 from a position within the locked portion (e.g., position A or position D) to an unlocked position (e.g., position B or position C) within the guide path 124, the user can then move the tabletop member 110 from the storage position to the usage position or visa-versa.

Figure 30:
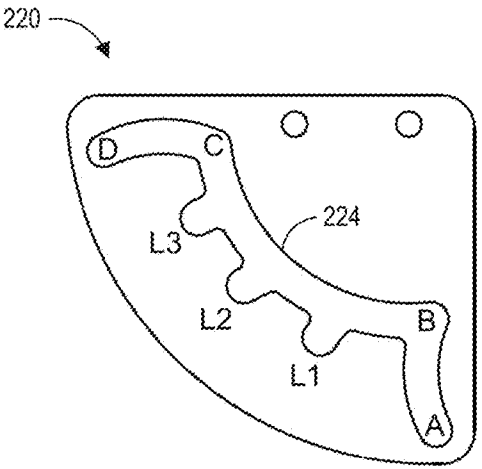
FIG. 30 is another embodiment of a movement control bracket.
Figure 31:
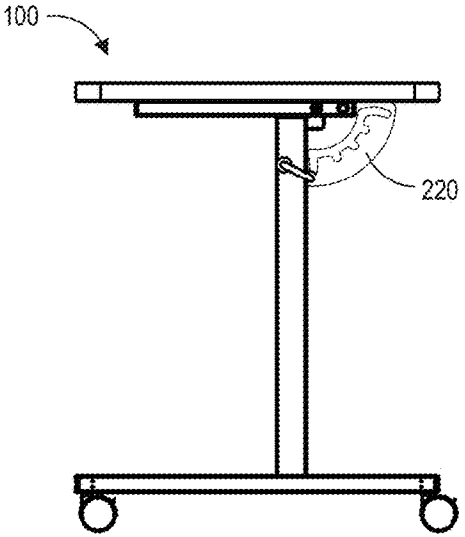
FIG. 31 a side view of a table with the bracket of FIG. 30.
Figure 32:
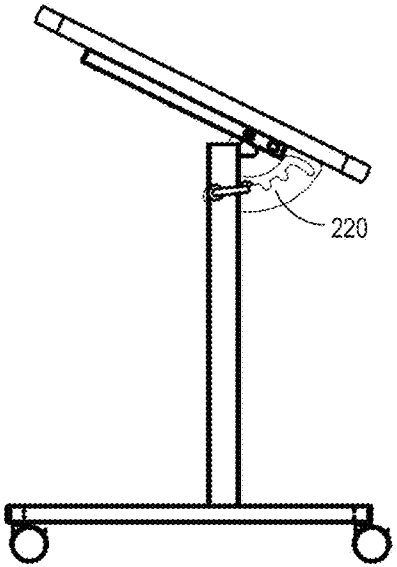
FIG. 32 a side view of a table in an intermediate position using the bracket of FIG. 30.
Figure 33:
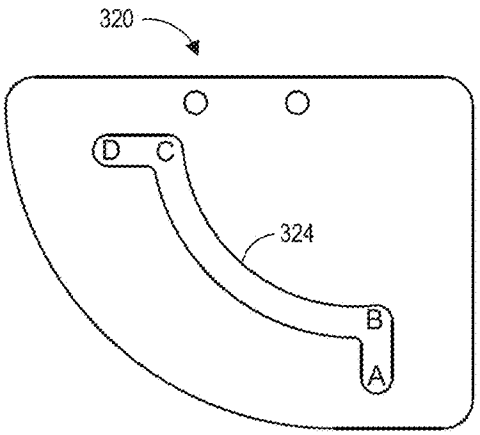
FIG. 33 is another embodiment of a movement control bracket.
Figure 34:
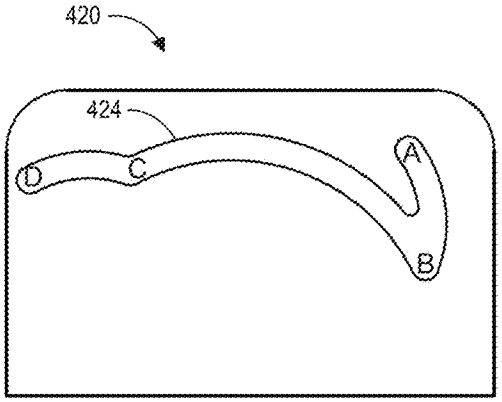
FIG. 34 is another embodiment of a movement control bracket.
Figure 35:
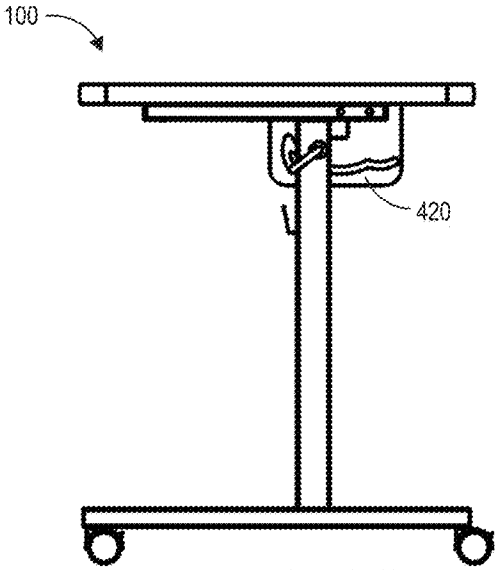
FIG. 35 a side view of a table in a first position with the bracket of FIG. 34.
Figure 36:
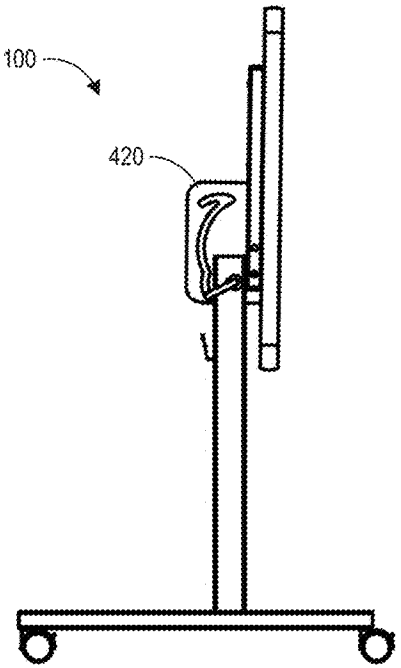
FIG. 36 a side view of a table in a second position with the bracket of FIG. 34.
Figure 40:
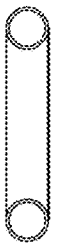
FIG. 40 is a right side view of the locking member of FIG. 37.
Figure 39:
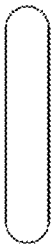
FIG. 39 is a left side view of the locking member of FIG. 37.
Figure 38:
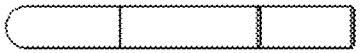
FIG. 38 is a top view of the locking member of FIG. 37.
Figure 37:
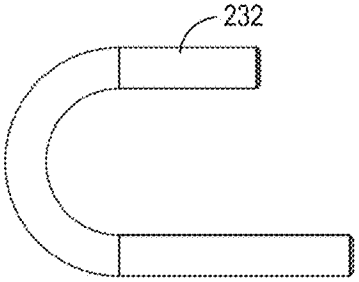
FIG. 37 is a front view of a locking member.
Figure 42:
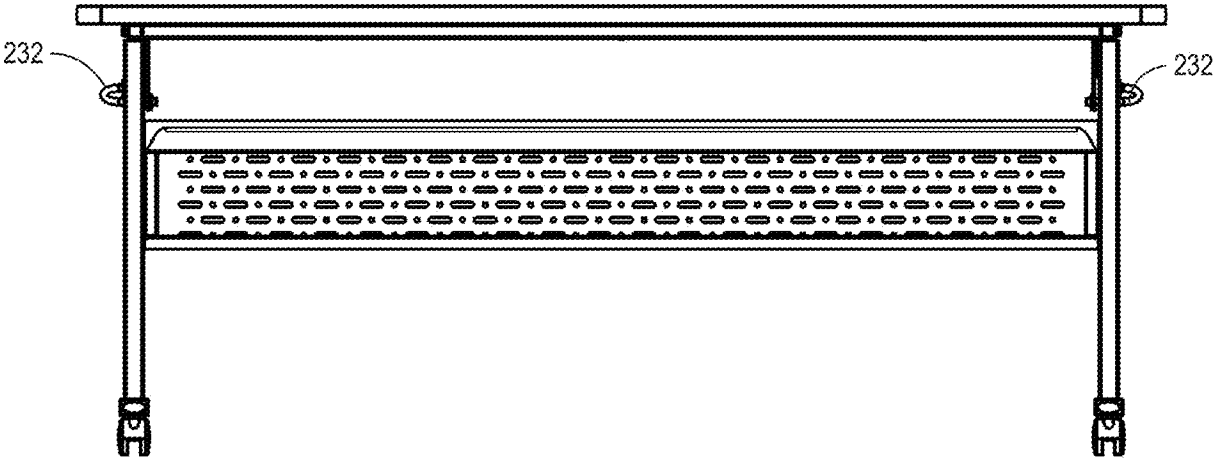
FIG. 42 a front view of a table with locking members of FIG. 37.
Figure 41:
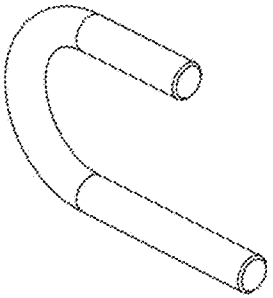
FIG. 41 is a perspective view of the locking member of FIG. 37.

With reference to FIGS. 30-32, another embodiment of the bracket is illustrated. The bracket 220 includes a guide path 124 that includes a plurality of intermediate locking positions L1, L2, and L3. The intermediate locking position allow a user to lock the tabletop member 110 into an angled position, such as illustrated in FIG. 32. Each intermediate locking position can be positioned so that the table is positioned at a defined angle. The locking member can move along the path BC until the user positions the locking member in one of the locking positions. In the illustrated configuration, the intermediate positions have a short path between the path BC and the locking position (L1, L2, or L3), In some configurations, the locking path can be the same or different length than paths AB or CD.

With reference to FIGS. 33-36, additional embodiments of brackets are illustrated. The brackets 320 and 420 illustrate additional embodiment of a guide path. The guide paths 324 and 424 have the same functionality as guide path 124 of bracket 120. The variations in guide paths can be determined based on many different factors, such as, for example, the configuration of the tabletop member 110, the legs 140, and the hinge structure(s) 118, the placement and shape of the bracket, and other aspects of the table 100.

With reference to FIGS. 23-26, the locking member 132 is illustrated. The locking member 132 includes end portions 134 and a middle portion 136. In the illustrated configuration, the locking member 132 has a rod-like structure with hooked end portions 134. The end portions 134 are configured to be secured with the openings 142 of the legs 140. The end portions are positioned within the guide path 124 of the bracket 120. In the illustrated configuration, the locking member is rotatably coupled to opening 142 so that it can move along the guide path 124. The user can grasp the middle portion 136 and/or the end portion 124 in order move the locking member 132 along a portion of the guide path 124 (such as AB or CD) in order to unlock the position of the tabletop member 110.

FIGS. 27-29 illustrate another configuration of locking member 132'. Locking member 132' includes a handle portion 138 of the middle section 136. The handle portion 138 can provide for an easier grip for a user to manipulate the locking member and move the member from a locked position to an unlocked position.

FIGS. 27-29 illustrate another embodiment of a locking member 232. Locking member 232 includes an end portion and no middle portion. The locking member 232 can be used in a table with one motion control bracket. In a table with two brackets, the locking member can be positioned on both sides and may require two people to move the table between usage and storage positions.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of it's variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims.

What is claimed is:

1. A table comprising:

a top member configured to move between a first position and a second position;

a first leg and a second leg opposing each other, the first leg comprising a first opening and the second leg comprising a second opening;

a first hinge component coupled to the top member and at least one of the first leg or the second leg;

a first movement guide bracket coupled to the top member, the first movement guide bracket comprising a guide path, the guide path comprising an elongate opening extending through the first movement guide bracket and having at least a first locking portion, a second locking portion, and a movement portion between the first locking portion and the second locking portion; and a locking member coupled to at least one of the first leg or the second leg, at least a portion of the locking member positioned within and extending through the elongate opening of the guide path of the first movement guide bracket, at least a portion of the locking member configured to move within the guide path when the first movement guide bracket, the top member moves between the first position and the second position, wherein when the locking member is positioned within and extending through the first locking portion of the guide path, the top member is locked in the first position;

wherein when the locking member is positioned within and extending through the second locking portion of the guide path, the top member is locked in the second position; and wherein when the locking member is positioned within and extending through the movement portion of the guide path, the locking member is configured to move within the guide path of the first movement guide bracket to allow the top member to move between the first position and the second position.

2. The table of claim 1, wherein in the first position, the top member is positioned substantially horizontal.

3. The table of claim 1, wherein in the second position, the top member is positioned substantially vertical.

4. The table of claim 1 further comprising a plurality of casters coupled to the first leg and the second leg.

5. The table of claim 1, further comprising a second movement guide bracket, wherein the first movement guide bracket is associated with the first leg and the second movement guide bracket is associated with the second leg.

6. The table of claim 5, wherein the locking member comprises an elongate body that extends from the from at least the first movement guide bracket to the second movement guide bracket.

7. The table of claim 1, wherein the locking member is configured to automatically move into the first locking portion after the top member moves from the second position to the first position.

8. The table of claim 7, wherein the locking member automatically drops into the first locking portion after the top member moves into the first position.

9. The table of claim 1, wherein the locking member substantially prevents angular movement of the top member when the locking member is positioned in the first locking portion of the guide path.

10. The table of claim 1, wherein the locking member is configured to automatically move into the second locking portion after the top member moves from the first position to the second position.

11. The table of claim 1, wherein the guide path further includes one or more intermediate locking portions positioned between the first locking portion and the second locking portion.

12. The table of claim 11, wherein the locking member is configured to lock the position of the top member in an intermediate position between the first position and the second position when the locking member is positioned in one of the one or more intermediate locking portions.

13. The table of claim 1, wherein the guide path is an arcuate path.

* * * * *